United States Patent [19]

Ayeva

[11] 4,452,163

[45] Jun. 5, 1984

[54] ARTICULATED COACH COUPLING MEANS

[76] Inventor: Aboudourahim Ayeva, 635, boulevard Laurentien, Saint-Laurent, Canada, H4M 2M2

[21] Appl. No.: 352,247

[22] Filed: Feb. 25, 1982

[51] Int. Cl.[3] ..... B63B 3/08

[52] U.S. Cl. ..... 114/77 R; 105/3; 105/11; 105/18; 114/250; 213/75 R

[58] Field of Search ..... 105/3, 11, 18; 213/75 R; 114/77 R, 248, 249, 250; 280/492, 493, 494; 308/227, 231; 414/4; 74/560

[56] References Cited

U.S. PATENT DOCUMENTS

| | | | |
|---|---|---|---|
| 447,053 | 2/1891 | Green | 105/11 |
| 2,226,424 | 12/1940 | Bullock | 74/560 |
| 2,664,300 | 12/1953 | Danielson et al. | 280/494 |
| 2,680,658 | 6/1954 | Addison | 308/227 |

FOREIGN PATENT DOCUMENTS

| | | | |
|---|---|---|---|
| 1468868 | 1/1967 | France | 114/250 |
| 889178 | 2/1962 | United Kingdom | 414/4 |
| 143676 | 9/1961 | U.S.S.R. | 114/249 |

*Primary Examiner*—Sherman D. Basinger

[57] ABSTRACT

An arrangement consisting of coupling elements allowing both pitch and yaw pivotal motion between two coupled modules or coaches, is disclosed. A transverse rod located at the end portion of one module is rigidly secured to a pair of arms and is supported thereby. These arms are rigidly connected to a king-post located in a casing. The king-post is adapted to pivot about its vertical axis. The end portion of the other module is provided with a pair of longitudinally-oriented shafts, each having an outer end provided with a pair of jaw members. The latter can open and close to effect coupling of the modules and are adapted to pivotally grip jaw-receiving portions on the transverse rod.

4 Claims, 8 Drawing Figures

Fig. 9
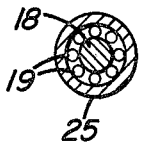
Fig. 3
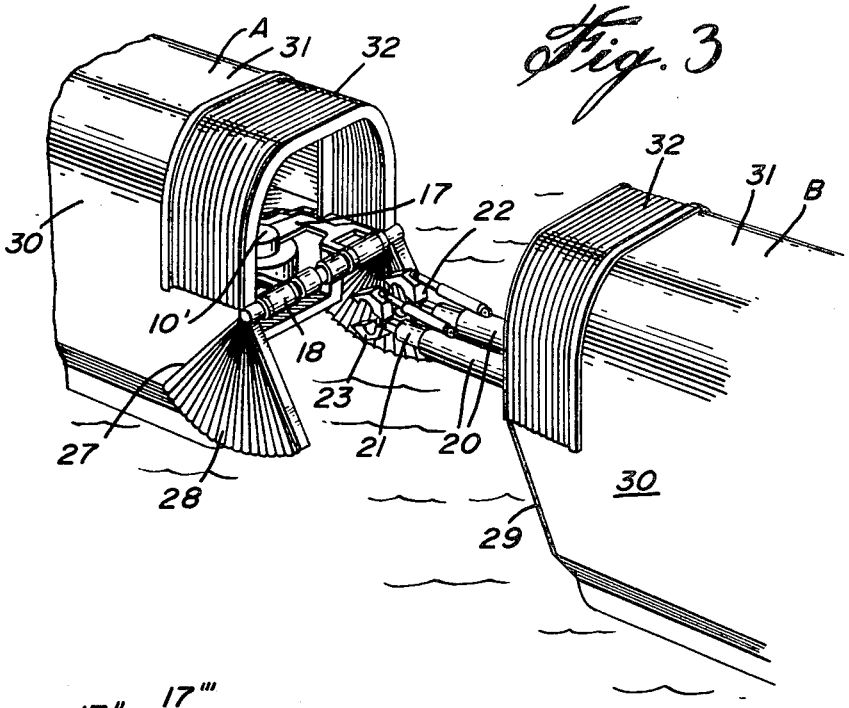
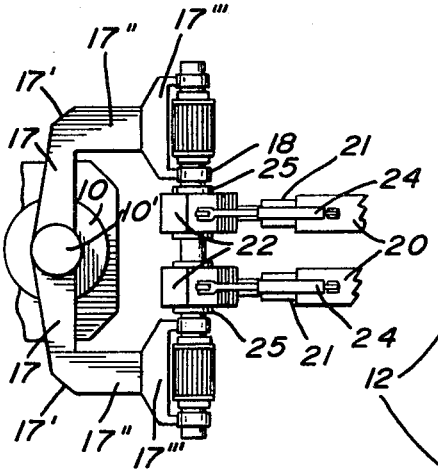
Fig. 5
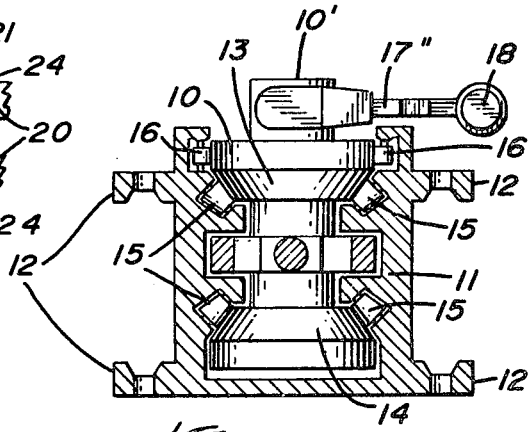
Fig. 4

ARTICULATED COACH COUPLING MEANS

FIELD OF THE INVENTION

The present invention relates to train coach coupling means, more particularly to coupling means which allows for pitch and yaw movement between two coaches coupled together and which is specifically designed for a novel type of train referred to hereinafter as a "hydrotrain".

BACKGROUND OF THE INVENTION

While boats have been known and built since time immemorial and trains have become an efficient means of transportation since the industrial revolution, heretofore the limits of technology have made it impossible to combine the two means of transportation in a successful manner. There have been, recently, innovations in water-craft, such as hydrofoils and hovercrafts, but these are limited in size, as are conventional ships, because of various factors. The "hydrotrain" of the present invention is, however, related to the above-mentioned water-craft, being composed of a plurality of coaches joined together and adapted to travel specifically over water (without necessarily excluding other surfaces).

Conventional trains have coaches or freight cars coupled together by a means which allows for lateral pivoting or yaw of one car relative to another joined to it, thereby enabling the train to travel in a curve without derailing.

If such a train were to be adapted to travel over water, such as a river, lake, lagoon or the sea, an ordinary coupling means would be inadequate because of agitation and waves on the water surface. For instance, a wave encountering one of the coaches would lift the latter relative to the forward and rear coaches coupled to it, causing a great strain on a conventional coupling means. On the other hand, an articulated coupling means designed for pitch movement (longitudinal pivoting in the vertical plane), as well as lateral movement, would ensure a comfortable and safe transportation, whether for cargo or passengers.

Although such an articulated coupling means would have to be very strong, especially for a "hydrotrain" navigating a trans-ocean route, the state of the mechanical art makes such a means possible.

OBJECTS OF THE INVENTION

Accordingly, it is a first object of the present invention to provide an articulated coupling means for at least two coaches coupled together as a water-going train or "hydrotrain" which is designed for both pitch and yaw pivoting of one coach relative to the other.

It is another important object of this invention to provide a coupling means of the above type, which is very strong and yet simple in design.

It is yet another object of this invention to provide a coupling means adapted to augment the seaworthiness of each coach without having recourse to the use of bulkheads.

SUMMARY OF THE INVENTION

The above and other objects and advantages of the present invention are realized according to a preferred embodiment comprising at least two coaches or modules of a "hydrotrain" linked together by the coupling means of the present invention. Hereinafter the two modules will be referred to as module "A" and module "B".

The latter are provided with a first assembly of coupling elements and a second assembly of coupling elements, respectively.

The first assembly includes an upright king-post pivotally mounted in module A adjacent one of the ends thereof and in a rigid casing. The king-post pivots about its central vertical axis and bearing means are provided to pivotally retain the same in the casing.

The upper portion of the king-post extends above the casing, having a rigidly-secured pair of transverse arms whose outer ends are disposed orthogonally and extend outwardly. These outer ends are in turn rigidly secured to, and thereby support, a transverse horizontal rod, which extends from one side wall to the other of module A. The rod is located approximately midway of the height of the module.

Depending from both opposite ends of the rod of module A is a flexible gusset-like element made of collapsible folds of material, as in a concertina. This element forms a portion of each lateral wall adjacent the associated end of module A below the rod and is secured by attaching means to the corresponding lower wall portions of module B. Each of these gusset-like elements can be inflated to provide buoyancy for the module, as will be more fully explained below, although this is not an essential feature of the coupling means.

The second assembly is fitted to the end of module B adapted to be joined to the assembly of module A, including the elements described above. This second assembly comprises a pair of spaced-apart, longitudinal and outwardly-extending shafts. The outer end of each shaft is provided with a pair of jaw members, an upper jaw and a lower jaw, which, when closed, define a circular transverse opening. Thus, the jaw members are adapted to be secured around the transverse rod of module A. Actuating means are provided to open and close the jaw members.

The two jaw-receiving portions of the transverse rod are provided with a second bearing means, thereby allowing pitch motion between the jaw members and the transverse rod, consequently pitch motion between the modules.

The upper wall portions and the roof of each module A and B at the ends thereof are provided with known "concertina vestibules" adapted to be linked together, thereby allowing a passageway between the modules for crew members or passengers.

The above will be more clearly understood by having referral to the preferred embodiment of the invention, illustrated by way of the accompanying drawings, in which:

BRIEF DESCRIPTION OF THE DRAWINGS

FIG. 3 is a perspective view of the end portion of two modules, showing the coupling means in de-coupled position;

FIG. 4 is a side elevation of the king-post and its casing, the latter being cross-sectioned;

FIG. 5 is a top plan view of the major portions of the two assemblies in coupled position;

FIG. 9 is a cross-section of the rod and of one of the jaw-receiving portions.

Like numerals refer to like elements throughout the drawings.

DETAILED DESCRIPTION OF THE INVENTION

Figure 1:
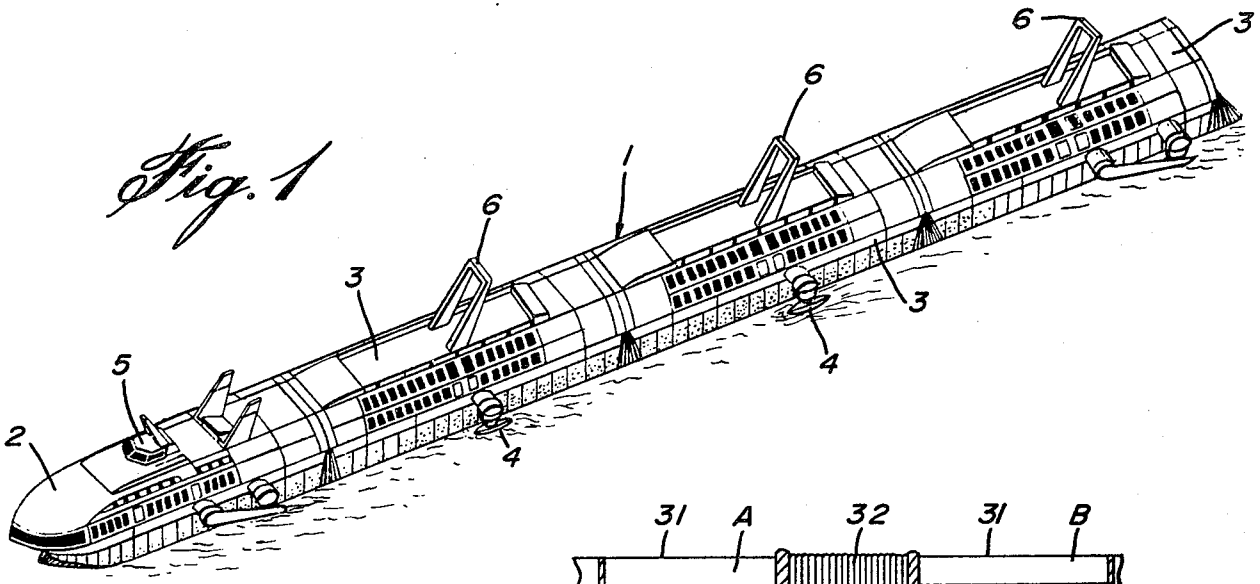
FIG. 1 is a perspective view of the "hydrotrain" according to the invention, showing a plurality of modules.
Figure 2:
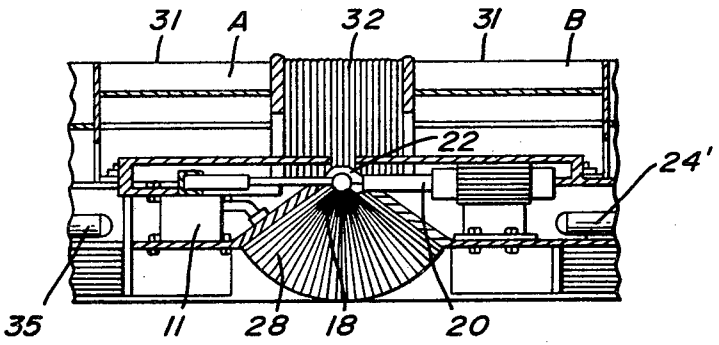
FIG. 2 is a partially cross-sectioned side elevation of two adjacent module portions coupled together.

Referring firstly to FIG. 1, there is shown a "hydrotrain" 1, including a front, head vehicle 2 and a plurality of coupled coaches or modules 3. The train is designed to travel over water, as suggested in the figure, and each module 3 can be provided with pontoons 4.

Head vehicle 2 has a cockpit 5. The roof of each module is provided with upwardly-projecting members 6 adapted to carry signal lights.

Each module is coupled to the other by the coupling means of this invention.

Referring now to the other figures, specifically FIGS. 2, 3, 6, and 7, there are illustrated the end portions of two modules (referred to as above, by the terms module A and module B), both in coupled and decoupled position. Module A is provided with the first assembly of elements. The latter comprises a king-post 10 (also shown in FIG. 4) vertically oriented and mounted in a strong rigid casing 11. Casing 11 is bolted by means of ears 12 to the interior end portion of module A, although other securing means could be employed.

King-post 10 is formed with two truncated conic sections 13 and 14 to provide added pivotal stability. Bearing means are provided to support king-post 10 in casing 11, consisting of truss bearings 15. Additional vertically-oriented bearings 16 are provided adjacent the upper portion of casing 11, also to ensure pivotal stability.

As seen clearly in FIG. 4, the top end 10' of king-post 10 projects above casing 11. A pair of transverse arms 17 are rigidly secured to this top end 10' on either side thereof. Each arm 17 has an elbow 17' and an integrally-formed, outwardly-extending portion 17'' terminating in double prongs 17'''. Both of the latter are rigidly secured to, and thereby support, at their respective lateral sides, a transverse and horizontal rod 18. Rod 18 is located approximately midway of the height of module A.

Module B is provided with the second assembly of elements. The latter consists of a pair of longitudinal, outwardly-extending, parallel and spaced-apart shafts 20, which are rigid and made of high strength material.

The outer end 21 of each shaft 20 has a jaw member defined by an upper jaw 22 and a lower jaw 23. Each jaw 22 and 23 has a semi-circular recess, such that, when they are closed together, a transverse circular opening is formed. Actuating means are provided to open and close jaws 22 and 23, consisting of hydraulic cylinders 24 and an oil compressor 24'.

It will be clear that the jaw members are designed to grip jaw-receiving sleeves 25 which surround the transverse rod 18 on opposite sides of king-post 10. To this end, the jaw-receiving sleeves 25 on rod 18 are provided with roller bearings 19, as shown in FIG. 9. Thus, both pitch and yaw movements are made possible for modules A and B.

The lower lateral wall edges 27 of both modules A and B are downwardly and inwardly cut away. Module A is provided with a gusset-shaped flexible wall member 28 on each side, made of folds of material like a concertina, having one edge attached to the edge 27 of module A. The apex of member 28 is secured to the rod 18, on each side. The other edge of each member 28 is adapted to be secured to the corresponding lower wall edge 29 of module B.

As mentioned above, each wall member 28 is inflatable, as the need requires, by means of an air compressor 35. For example, if the "hydrotrain" is in port, extra buoyancy may be desired. One advantage of members 28 is that bulkheads need not be included in either module A or module B. Another advantage is that the modules can be made virtually unsinkable, in the event of an accident at sea, by means of members 28.

Figure 6:
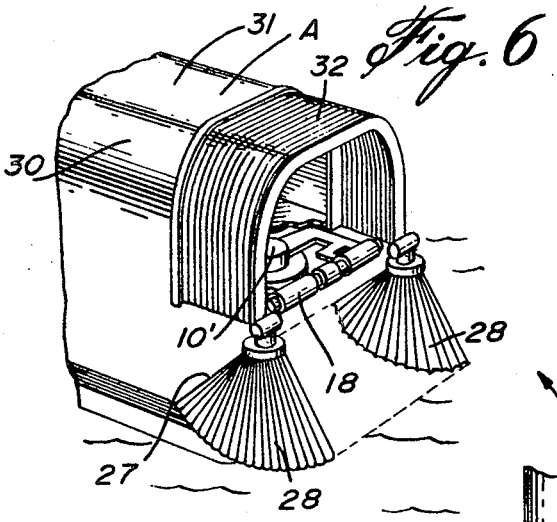
FIG. 6 is another perspective view of the end portion of a module provided with the first assembly of the coupling means.
Figure 7:
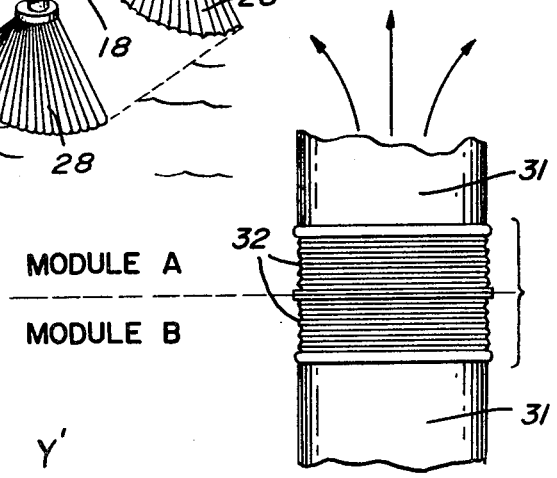
FIG. 7 is a top plan view of the end portions of two modules coupled together.
Figure 8:
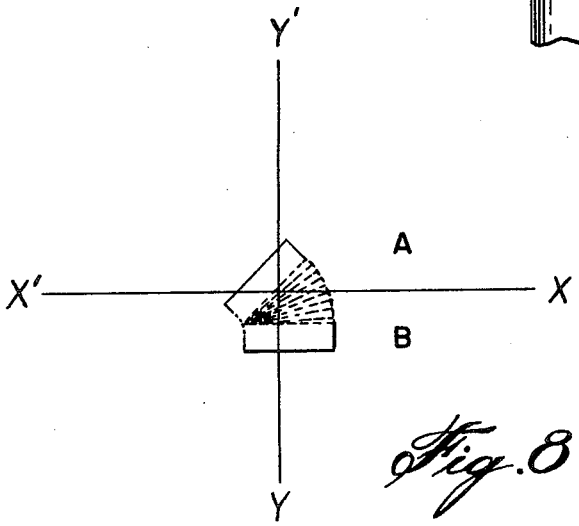
FIG. 8 is a schematic representation of two modules executing lateral motion relative to one another.

FIG. 6 illustrates a modified embodiment of the first assembly of module A wherein the transverse rod is located inwardly of the wall members 28 and is not connected to the latter. Otherwise, the construction and function of this modified assembly are the same.

The upper lateral wall edges 30 of both modules A and B and the roof portions 31 thereof are provided with a U-shape concertina vestibule 32 of a known type, such as are used in conventional passenger trains.

Although the invention has been disclosed and described in terms relating specifically to a novel type hydrotrain, it is to be understood that the coupling means can be successfully used with any other kind of linked vehicles or modules. For examples, it is envisioned that such modules be designed for underground water canal subways, or amphibious construction for travel over land and lakes and river systems.

What I claim is:

1. An articulated coupling means for a first elongated and a second elongated coach adapted to be linked together; said articulated coupling means comprising a first assembly of coupling elements, carried by one end of said first coach, a complementary second assembly of coupling elements carried by one end of said second coach; said first assembly including an upright king-post rotatably mounted in a rigid casing secured to said one end of said first coach; bearing means provided in said casing to allow said king-post pivotal movement about its vertical axis; a transverse substantially horizontal rod rigidly secured to the upper portion of said king-post and extending on each side of said post; two jaw-receiving sleeves surrounding said rod on opposite sides of said king-post; said second assembly including a pair of parallel, spaced-apart and longitudinally-oriented rigid shafts mounted on said one end of said second coach, each shaft having an outer end, each said outer end being provided with a pair of articulated jaw members which, when closed, define a transverse circular opening, actuating means to open and close each said pair of jaw members, the latter being adapted to grasp said jaw-receiving sleeves; and a second bearing means between said jaw-receiving sleeves and said rod thereby allowing pitch movement between the said first and second assembly of elements.

2. An articulated coupling means as claimed in claim 1, wherein said rod is secured to said king-post forwardly of the latter by a pair of elbow-shaped arms secured to said king-post at one end and to said rod at its other end.

3. An articulated coupling means as claimed in claim 1, wherein each said jaw member consists of an upper jaw and a lower jaw, each having a mutually-facing semi-circular recess.

4. An articulated coupling means as claimed in claim 1 or 2 wherein said first and second coaches both have at their ends upper and lower lateral wall edges and a roof portion edge, said lower lateral wall edges downwardly and inwardly extending relative to said upper lateral wall edges, and further including an inverted U-shaped concertina vestibule secured to said roof portion edge and to said upper lateral wall edges, and an inflatable flexible gusset-shaped wall member secured to each lower lateral wall edge.

* * * * *